United States Patent [19]

Malecha

[11] Patent Number: 4,937,956

[45] Date of Patent: Jul. 3, 1990

[54] OCEAN FLOOR DREDGING

[75] Inventor: Miloslav Malecha, Zoetmeer, Netherlands

[73] Assignee: Manaco International, Geneva, Switzerland

[21] Appl. No.: 228,276

[22] Filed: Aug. 4, 1988

[30] Foreign Application Priority Data

Aug. 7, 1987 [GB] United Kingdom ..... 8718769

[51] Int. Cl.[5] ..... E02F 3/08

[52] U.S. Cl. ..... 37/69; 37/DIG. 8; 37/DIG. 2; 299/9; 198/509; 198/711; 198/584

[58] Field of Search ..... 37/69–71, 37/75, 76, 78, 192 R, DIG. 2, DIG. 8, DIG. 19, 54; 299/9; 405/158; 198/307.1, 509, 711, 834

[56] References Cited

U.S. PATENT DOCUMENTS

| | | | |
|---|---|---|---|
| 3,672,488 | 6/1972 | Collins | 198/834 |
| 3,697,134 | 10/1972 | Murray | 37/DIG. 8 |
| 3,766,671 | 10/1973 | Guntert | 198/711 X |
| 3,889,403 | 6/1972 | Gauthier et al. | 37/195 X |
| 3,943,644 | 3/1976 | Walz | 37/69 |
| 3,968,579 | 7/1976 | Rossfelder | 37/69 |
| 4,055,006 | 10/1977 | Shibata | 37/DIG. 8 X |
| 4,226,035 | 10/1980 | Saito | 37/69 |
| 4,446,636 | 5/1984 | Weinert | 37/54 |

FOREIGN PATENT DOCUMENTS

| | | | |
|---|---|---|---|
| 322763 | 7/1920 | Fed. Rep. of Germany . | |
| 2404584 | 4/1979 | France . | |
| 609841 | 6/1978 | U.S.S.R. | 37/DIG. 2 |
| 610932 | 6/1978 | U.S.S.R. | 37/DIG. 2 |
| 690275 | 4/1953 | United Kingdom . | |

*Primary Examiner*—Dennis L. Taylor
*Assistant Examiner*—Arlen L. Olsen
*Attorney, Agent, or Firm*—Beveridge, DeGrandi & Weilacher

[57] ABSTRACT

A system of ocean floor dredging comprises a first vessel, two rotatable rollers on the vessel, a third roller lying on the ocean floor, and an endless net extending around the three rollers.

11 Claims, 6 Drawing Sheets

OCEAN FLOOR DREDGING

TECHNICAL FIELD

This invention is concerned with ocean floor dredging such as the collection of manganese nodules which occur on the sea bed.

BACKGROUND ART

Many proposals have been made for dredging of the ocean floor including using a series of buckets connected to an endless cable or chain, devices which are self-propelled or are dragged along the sea floor, and suction apparatus. The principal drawback with many of these is their complexity with the attendant risk of something going wrong, and the first or capital cost.

The object of the invention is to provide a relatively simple and efficient system of ocean floor dredging.

DISCLOSURE OF THE INVENTION

The invention provides a system of ocean floor dredging comprising a first vessel, two rollers rotatably mounted on the first vessel, at least one of which is drivable in rotation, the roller axes extending cross-wise and the rollers being spaced from each other fore and aft of the vessel, a third roller lying on the ocean floor and an endless net having means for collecting material from the ocean floor, the net extending around the three rollers.

The advantage with the use of a net is that it is a relatively simple structure which can be relatively easily made at low cost. By using a material such as nylon, the total mass can be kept low and it can be made buoyant. This means that less power is required to operate the apparatus. Also, with using a net there is less resistance or drag when being pulled through the water.

The purpose of the third roller is to keep the net in contact with the sea floor.

A system according to the invention can provide a relatively simple and reliable way of dredging the sea floor to retrieve commercially attractive minerals.

Preferably, second and third vessels are connected to the third roller by means of cables, the second and third vessels lying astern of and to opposite sides of the first vessel. The purpose of these second and third vessels is to guide the third roller. Preferably, the cables are connected to constant tension winches on the second and third vessels.

The means can be pins or scoops which may have one or more pins in each one, which pins or scoops can be arranged in strips extending transversely of the net.

DETAILED DESCRIPTION OF THE INVENTION

Figure 1:
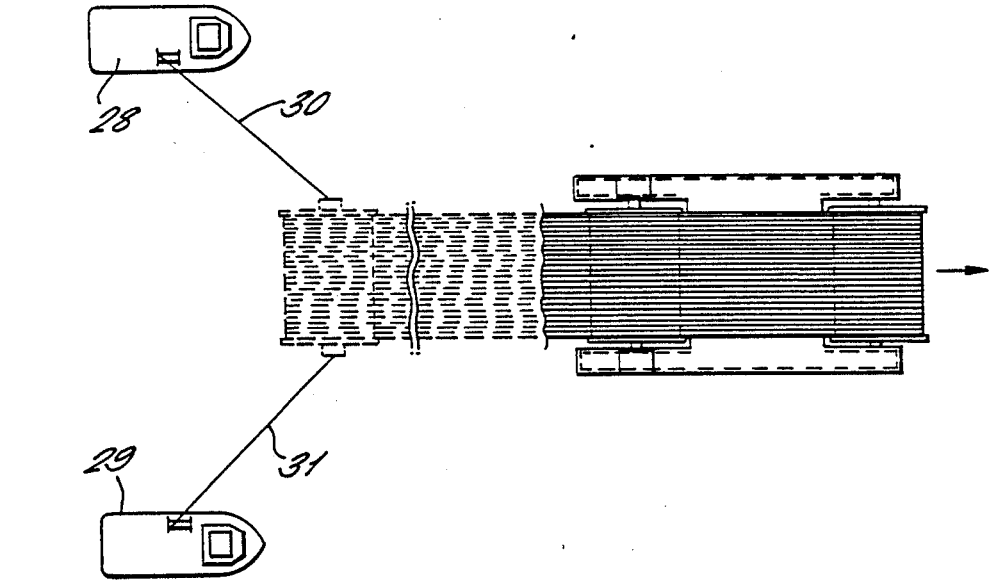
FIG. 1 is a plan of a system of ocean floor dredging.
Figure 2:
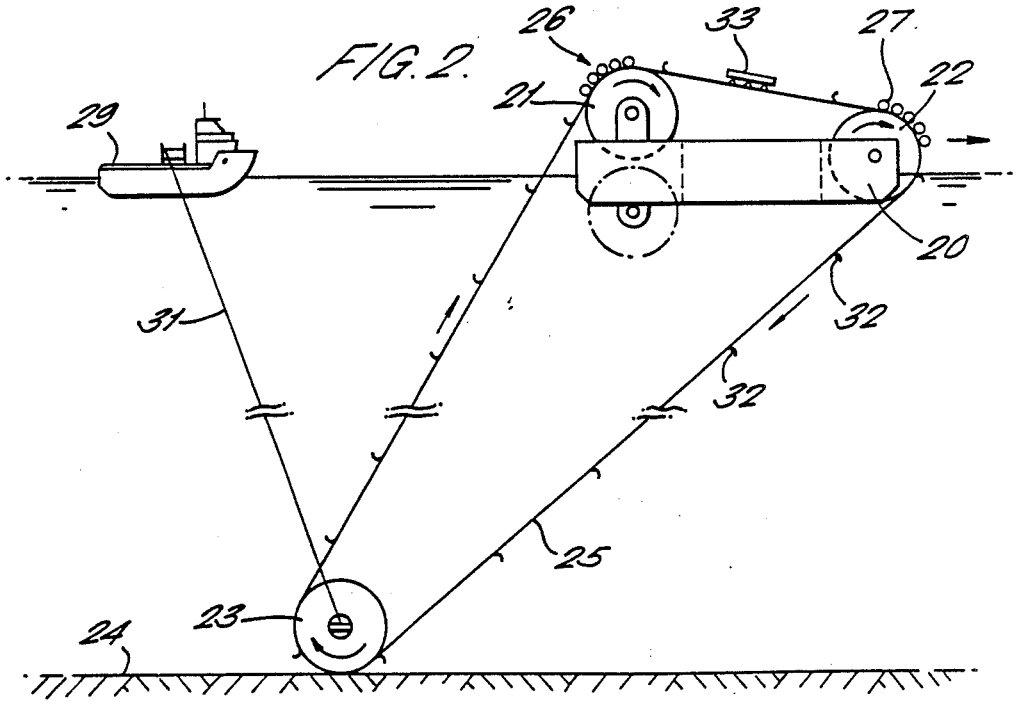
FIG. 2 is a side view of the system of FIG. 1.

FIGS. 1 and 2 show a system for dredging a sea bed or ocean floor comprising a dredging first vessel 20 on which are rotatably mounted first and second rollers 21 and 22. The rollers 21 and 22 have their axes extending transversely of the vessel 20 and are spaced from each other fore and aft. A third roller 23 lies on the ocean floor 24. An endless conveyor net 25 extends around the three rollers 21, 22 and 23, the third roller 23 keeping the net 25 in contact with the sea bed 24.

Both of the rollers 21 and 22 on the first vessel 10 are power driven to provide the net 25 with the necessary tension and co-operate with hydraulic pressure rollers 26 and 27 to prevent slippage of the conveyor net 25.

Second and third vessels 28 and 29 lie astern of and to opposite sides of the first vessel 20. Each second and third vessel 28, 29 has a constant tension winch with a cable 30, 31 connected to the third roller 23.

The conveyor net 25 has scoops 32 which bring material from the sea bed 24 up to the dredging vessel 20, where at a location between the two rollers 21 and 22, high pressure air jets 33 remove the material from the conveyor net. The dislodged material falls into a storage area or work station. The material is then transported to a storage vessel or subject first to a primary crushing/powdering operation before being transported.

The first vessel 20 is self-propelled and has means for forward and sideways movement. With the aid of two TV cameras mounted on the third roller 23 and connected to the dredging vessel 20, and a dynamic positioning system, the movement and position of the third roller 23 is carefully controlled by the movement of the first vessel 20 and the constant tension winches of the second and third vessels 28 and 29. In use, the movement of the net 25 around the roller 23 causes it to rotate and roll along the sea bed, and forward movement of the dredging vessel 20 causes it to move forward. This movement of the third roller 23 is carefully synchronised with the rotational movement of the two rollers 21 and 22. In the event of an emergency, the cables 30 and 31 can be used to raised the roller 23 to a safe height.

If the dredging vessel 20 is towed by a tug-boat, the dynamic positioning system is superfluous.

Figure 3:
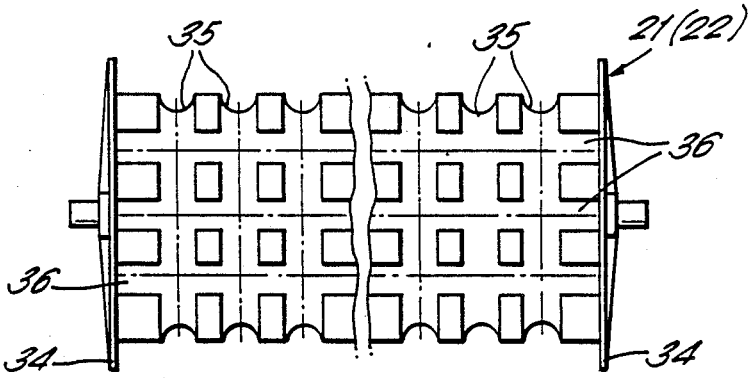
FIG. 3 is a view of a roller mounted on a first vessel.

FIG. 3 shows in more detail the roller 21 (22). It has two flanges 34 one at each end to prevent sideways movement of the net 25, and circumferential grooves 35 and transverse grooves 36 which co-operate with the conveyor net 25.

Figure 4:
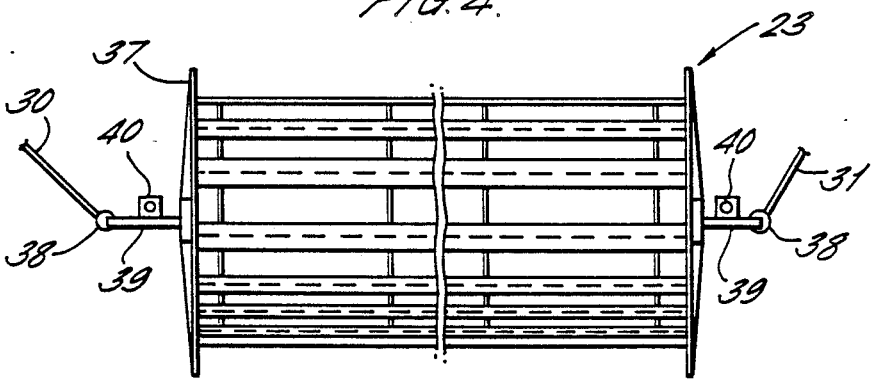
FIG. 4 is a view of a third roller for travelling along the sea bed.

FIG. 4 shows in more detail the third roller 23 which is of an open construction to permit the free through-flow of water. It also has two flanges 37 one at each end which prevent the net 25 from slipping-off. The cables 30 and 31 are connected to hinged eyes 38 at the end of stub shafts 39. The TV cameras 40 are also mounted on these stub-shafts 39.

Figure 5:
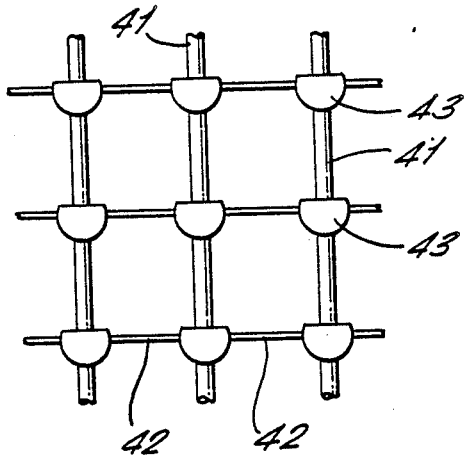
FIG. 5 is a plan of a net having scoops for use in dredging.
Figure 6:
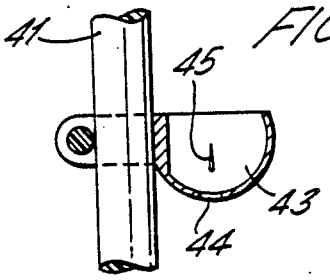
FIG. 6 is a section of a scoop.
Figure 7:
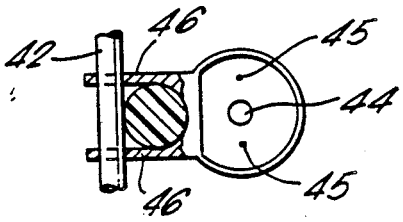
FIG. 7 is a plan of the scoop.

FIGS. 5, 6 and 7 show one type of conveyor net. It has main longitudinal cables 41 and cross-cables 42 made of, for example, nylon. At each intersection of the longitudinal and cross-cables 41 and 42 is a scoop 43. Each scoop 43 has a drainage hole 44 and two pins 45 to retain material scooped from the sea bed in the scoop. Each scoop 43 is either made of a synthetic material or a light metal. It is secured in place by two legs 46 between which passes the longitudinal cable 41, and the transverse cable 42 passes through two holes in the ends of the legs 46.

Figure 8:
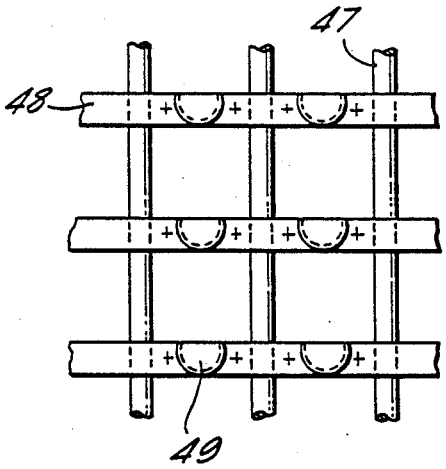
FIG. 8 is a plan of a different net having scoops for use in dredging.
Figure 9:
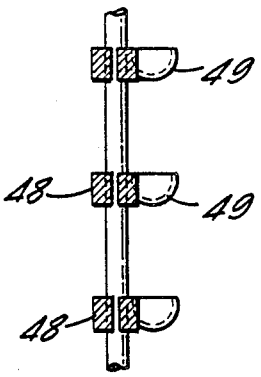
FIG. 9 is a vertical section of the net.
Figure 10:
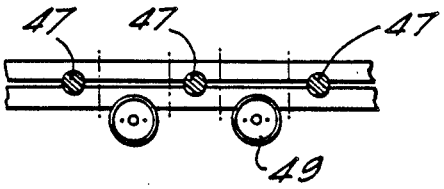
FIG. 10 is a cross-section of the net.

FIGS. 8, 9 and 10 show another type of conveyor net which has main longitudinal cables 47 of, for example, nylon with cross-beams 48 of light metal. The longitudinal cables 47 pass through bores in the cross-beams 48 and are fixed thereto. Scoops 49 are attached to or are an integral part of the cross-beams 48. These scoops 49 also have drainage holes and pins.

Figure 11:
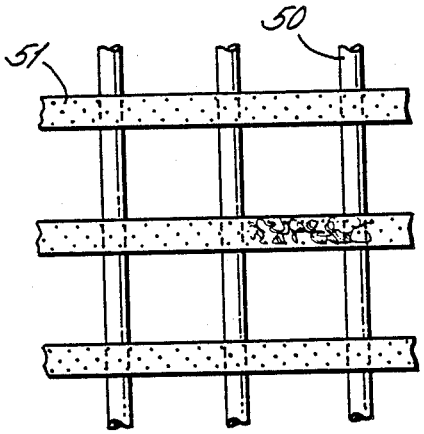
FIG. 11 is a plan of another net having strips of pins for use in dredging.
Figure 12:
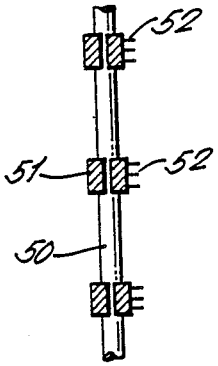
FIG. 12 is a vertical section of the net.
Figure 13:
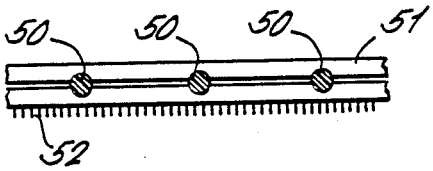
FIG. 13 is a cross-section of the net.

FIGS. 11, 12 and 13 show a further type of net which comprises main longitudinal cables 50 of, for example, nylon, and cross-beams 51. The cross-beams 51 have apertures through which the cables 50 extend and are fixed thereto. The cross-beams 51 have a plurality of up-standing pins 52 for collecting material from the sea bed.

Figure 14:
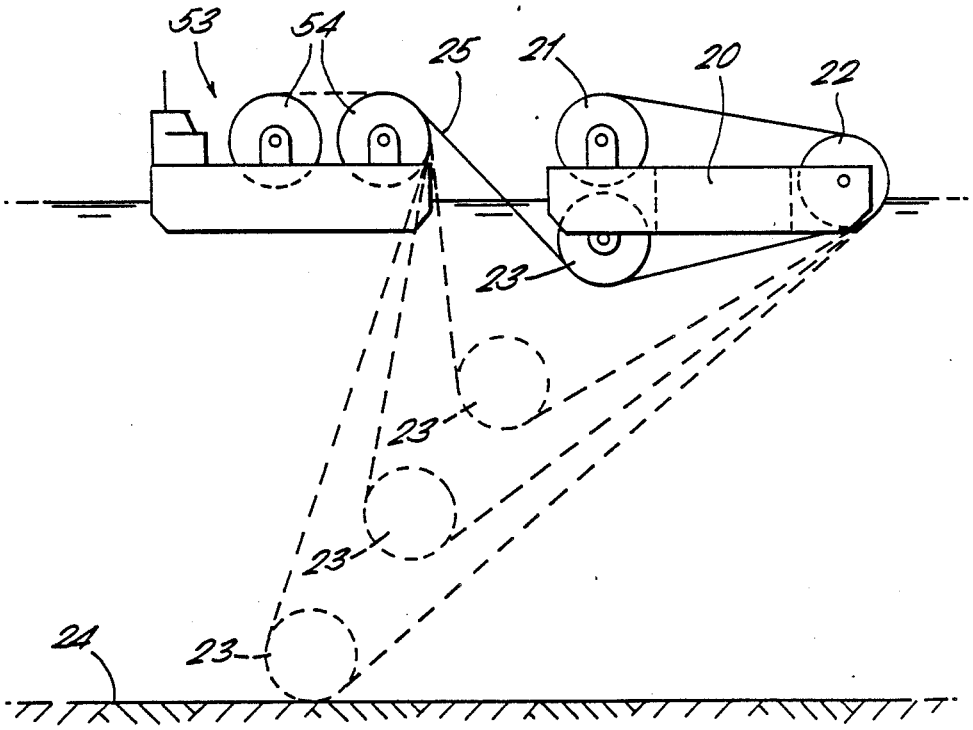
FIG. 14 shows the stages used in setting up the system for dredging.

FIG. 14 shows how the dredging system is set up. The dredging vessel 20 arrives at the desired region, with its two drive rollers 21 and 22 and the third roller 23 is connected to its underside. The conveyor net 25 is delivered by a fourth vessel 53 stored in lengths of say 500 meters on large reels 54. A lead cable attached to one end of the conveyor net on the first reel 54, is passed underneath the roller 23, over the roller 22 and around the roller 21 to a winch. This winch winds in the lead cable and draws the net 25 over the rollers. The roller 23, with the TV cameras and attached by the cables 30 and 31 to the second and third vessels 28 and 29, is disconnected from the dredging vessel 20 and lowered by the cables at the same time as the conveyor net 25 is played out. When the first reel 54 is empty, the net on the second reel is spliced-in and the procedure repeated until the roller 23 is on the ocean floor 24. Then the two ends of the conveyor net 25 are coupled together and dredging can commence. The depth at which dredging can be carried out is between 3000 and 6000 meters.

What I claim is:

1. A system of ocean floor dredging comprising a first vessel, two rollers rotatably mounted on the first vessel, at least one of which is drivable in rotation, the roller axes extending cross-wise and the rollers being spaced from each other fore and aft of the vessel, a third roller lying on and directly supported by the ocean floor and an endless net having means for collecting material from the ocean floor, the net extending around the three rollers, the third roller being positioned to roll along the ocean floor as the net is passed around it.

2. A system as claimed in claim 1, wherein second and third vessels are connected to the third roller by means of cables that are means for guiding the movement of the third roller along the ocean floor, the second and third vessels lying astern of and to opposite sides of the first vessel.

3. A system as claimed in claim 2, wherein the cables are connected to constant tension winches on the second and third vessels.

4. A system as claimed in claim 2, wherein TV cameras are mounted one at each end of the third roller and are connected to one of the vessels.

5. A system as claimed in claim 1, wherein the first and second rollers have circumferential grooves and transverse grooves.

6. A system as claimed in claim 1, wherein the first and second rollers co-operate with other rollers to prevent slippage of the net, the said other rollers being urged towards the first and second rollers with the net therebetween.

7. A system as claimed in claim 1, wherein the third roller is of open construction to permit the free through-flow of water.

8. A system as claimed in claim 1, wherein the third roller has flanged ends.

9. A system as claimed in claim 1, wherein the first vessel has means for removing collected material from the net.

10. A system as claimed in claim 9, wherein the means comprises high pressure air jets directed against the net.

11. A system as claimed in claim 1, wherein the first vessel is adapted to connect the third roller in its underside.

* * * * *